United States Patent [19]

Isobe et al.

[11] 4,361,443

[45] Nov. 30, 1982

[54] SOLID SOLUTION STRENGTHENED IRON-BASE AUSTENITIC ALLOY

[75] Inventors: Susumu Isobe, Ibaraki; Hajime Nakajima, Mito; Tatsuo Kondo, Mito; Katsutoshi Watanabe, Mito; Yasukazu Ishida, Tokyo; Takeshi Okada, Tokyo; Taiki Kobayashi, Tokyo, all of Japan

[73] Assignees: Japan Atomic Energy Research Institute; Power Reactor and Nuclear Fuel Development Corporation, both of Tokyo, Japan

[21] Appl. No.: 150,944

[22] Filed: May 19, 1980

[30] Foreign Application Priority Data

Oct. 22, 1979 [JP] Japan ..... 54/136082

[51] Int. Cl.[3] ..... C22C 38/22

[52] U.S. Cl. ..... 75/128 W

[58] Field of Search ..... 75/128 W; 148/12 E

[56] References Cited

U.S. PATENT DOCUMENTS

| | | | |
|---|---|---|---|
| 2,544,336 | 3/1951 | Linnert | 75/128 W |
| 2,587,613 | 3/1952 | Payson | 75/128 W |
| 2,819,161 | 1/1958 | Cupler | 75/128 W |
| 3,856,517 | 12/1974 | Bates et al. | 75/128 W |

*Primary Examiner*—W. Stallard

*Attorney, Agent, or Firm*—Browdy and Neimark

[57] ABSTRACT

A solid solution strengthened iron-base austenitic alloy is suitable for use in nuclear reactors having low oxidizing environment. It has a composition of 8 up to but not including 16.0% by weight of Cr, 14–35% by weight of Ni, 5–15% by weight of Mo plus 0.522 W, up to 1.0% by weight of Ti, up to 2% by weight of Mn, up to 1% by weight of Si, up to 0.1% by weight of C and the balance iron and unavoidable impurities.

5 Claims, 1 Drawing Figure

SOLID SOLUTION STRENGTHENED IRON-BASE AUSTENITIC ALLOY

Figure 1:
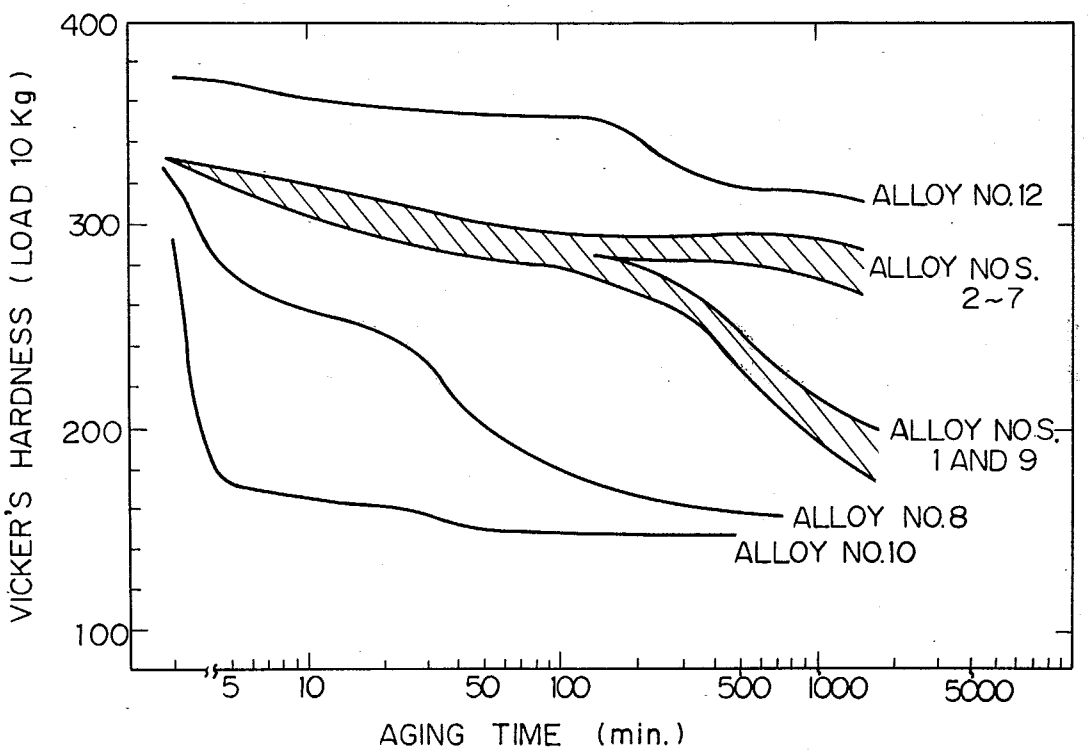

The present invention relates to a solid solution strengthened iron-base austenitic alloy.

The austenite steel of the present invention is widely useable for heat-resisting material similarly to stainless steel and other heat-resisting steels, and is especially suitable as heat-resisting material for use in nuclear reactors having low oxidizing environment such as liquid-metal fast breeder reactor (LMFBR).

Although 20% cold-worked type 316 stainless steel and its modified versions are conventionally used for core materials of LMFBR, some technical barriers in their extended uses for the advanced systems have been pointed out. That is to say, they are insufficient in properties such as creep rupture strength, resistance to the void swelling due to fast neutron-irradiation, phase stability and so forth, because type 316 stainless steel was a material developed originally to combat corrosion in acid and other high oxidizing environments. On the other hand, the applicability of nickel-base alloy strengthened with $\gamma$-phase as typically represented by "NYMONIC PE 16®" for core materials has been investigated. Since, however, the Ni content of nickel-base alloy is high, it has serious disadvantages such as corrosion of nickel due to the dissolution of nickel into the flowing hot sodium, an increase of induced radioactivity in the system, an increase of the susceptibility to the irradiation-induced intergranular cracking during creep deformation due to the transmuted helium, neutron economy, workability and so forth when it is used for core materials. As stated above, the conventionally used alloys are unsuitable for use as core materials of advanced LMFBR's, and therefore, a novel alloy satisfying the special requirements for nuclear reactor has been desired in the art.

Accordingly, it is an object of the present invention to provide a novel solid solution strengthened iron-base austenitic alloy having improved creep rupture strength, resistance to neutron-induced void swelling, phase stability, corrosion resistance in the flowing hot sodium, resistance to the ductility loss under irradiation at elevated temperatures and so forth.

Other objects and advantages of the present invention will become apparent from the following description, taken in conjunction with the drawing wherein FIG. 1 shows the softening trends during heating after 50% cold rolling.

The inventors of the present invention have been undertaking research and development of a novel alloy which withstands the environment of core of LMFBR and which is excellent in properties such as creep rupture strength, resistance to neutron-induced void swelling, phase stability, corrosion resistance in the flowing hot sodium, resistance to ductility loss under irradiation at elevated temperatures and so forth. At the beginning, the inventors of the present invention studied the method for improving the high-temperature strength of Cr-Ni-Fe base heat-resistant austenitic alloys. In view of the mutually opposite functions for the stability of austenite between Ni and Cr, the generally recognized trends of these two elements in influencing the sensitivity to void swelling have special significance. Despite its negative contribution to the austenite stability, Cr has been commonly added to most heat-resistant austenitic alloys due to its beneficial functions of both solution strengthening and oxidation resistance to "high oxidizing potential" environments. Nickel, on the other hand, is an austenite stabilizer and is the major base element in most heat resistant alloys. There are unfortunate contradictions in the use of higher Ni contents. Ni, above 30 w/o, has been reported to give good resistance to void swelling, on the other hand, increasing Ni content may cause more dissolution of the material into the flowing hot sodium and the associated radioactivity accumulation in the primary circuit may be another drawback. Furthermore, the higher Ni alloys are suspected to be more susceptible to the irradiation-induced intergranular cracking during creep deformation due to the helium formed in the material by nuclear transmutation effects. Therefore, according to the present invention, the inventors of the present invention designed the solid solution strengthening by virtue of molybdenum and tungsten which are substitutional elements. Since these elements reduce the phase stability of austenite, the basic chemical composition of Cr-Ni-Fe and contents of Mo+W are calculated by adopting PHACOMP method to design the phase stability of alloy. The procedure of the calculation is as follows;

(a) Calculation of atomic fractions of atomic elements including B, C, Co, V, Ta, Nb and Al in accordance with the change in Cr, Ni, Fe, Mo, W, Mn, Si and Ti.

(b) Subtraction of the fractional parts of the elements that form borides and carbides upon long term aging at the expected service temperatures.

(c) Calculation of average electron vacancy number ($\overline{Nv}$) based on the residual matrix of alloy in accordance with the following equation;

$$\overline{Nv} = 0.66\,Ni + 2.66\,Fe + 3.66\,Mn + 4.66\,(Cr + Mo + W) + 6.66\,(Si + Ti) \quad (1)$$

It is expected that less $\overline{Nv}$ causes the reduction of void swelling, and therefore, $\overline{Nv}$ is controlled down to levels less than 2.7 by the present invention. In accordance with the calculation above, it is required to decrease Cr content while increasing Ni content in order to improve the high temperature strength of alloy by increasing Mo+W contents without reducing the phase stability. The inventors of the present invention have found that a decrease in Cr content does not cause deterioration of corrosion resistance in a low oxidizing environment, but improves the resistance to void swelling. Nickel is an effective alloying element for phase stability, but the Ni content should be limited to the irreducible minimum from the standpoint of the irradiation-induced intergranular cracking during creep deformation due to the transmuted helium and corrosion in the flowing hot sodium. And furthermore, the chemical composition of the alloy of the present invention (Weight percent) was controlled so as to satisfy the equation (2) in order to inhibit the formation of $\delta$ ferrite;

$$4.38 + 24.5\,C - 0.44\,Si + 0.11\,Mn + Ni - 0.92\,Cr - 1.11\,Mo - 0.66\,W - 2.02\,Ti > 0 \quad (2)$$

The alloys of the present invention prepared on the basis of the theory described above consist essentially of (by weight) 8–16% Cr, 14–35% Ni, 5–15% Mo plus 0.522 W, up to 1.0% Ti, up to 2% Mn, up to 1% Si, up to 0.1% C and the balance iron and unavoidable impurities. The alloy of the present invention is superior to type 316 stainless steel conventionally and widely used in the art in mechanical properties such as tensile strength at elevated temperatures and creep rupture strength as well as the resistance to softening trends after cold working. In addition, the mechanical properties of the alloy of the present invention may be improved by adding a trace amount of certain alloying elements such as B or Nb into the alloy of the present invention.

The reasons for limiting the content of the alloy of the present invention are given below;

Cr: A lower chromium content is preferred in terms of the resistance to void swelling, phase stability and corrosion resistance under low oxidizing potential environment. The chromium content, however, is limited to 8.0–16.0% by weight in order to keep necessary resistance to oxidation during the hot forming processes of the alloy and to obtain sufficient stability of austenite without using a higher nickel content.

Ni: A higher nickel content is preferred in terms of phase stability and resistance to void swelling. However, the nickel content of this alloy is limited to 14.0–35.0% by weight in terms of keeping the corrosion resistance in the flowing hot sodium, the control of induced radioactivity as well as the establishment of the resistance to ductility loss under irradiation at high temperatures.

Mo plus 0.522 W: A higher molybdenum content plus 0.522 tungsten, which gives the Mo-equivalent of W in terms of normalizing atomic weigh difference, is preferred in terms of effective solid solution strengthening and the resistance to void swelling. However, the content of Mo plus 0.522 W is limited to 5.0–15.0% by weight in terms of phase stability and formability.

Ti: Addition of proper amount of titanium plays an effective role in improving the tensile strength, creep-rupture strength as well as the resistance to void swelling and ductility loss under neutron-irradiation at high temperatures without affecting basic ductility. However, higher titanium content results in remarkable reduction of ductility due to the formation of coarse titanium carbide. The titanium content, therefore, is limited to up to 1.0% by weight in the present invention.

For the purpose of giving those skilled in the art a better understanding and/or a better appreciation of the advantages of the invention, the following illustrative data are given.

EXAMPLES AND REFERENCE EXAMPLES

A series of alloys having chemical compositions given in Table 1 (Alloy Nos. 1–7 are within the present invention and Alloy Nos. 8–12 are reference) were melted in vacuum high frequency induction furnace, cast into billets homogenized, hot forged and then hot-rolled to plates of 2.0, 2.5, 8.0 and 10.0 mm in thickness. Then, the alloys in the form of plate were subjected to solution annealing treatment at temperatures suitable for solid solution treatment for each alloy in order that possible maximum amount of solution strengthening elements such as chromium, molybdenum and tungsten, were dissolved into the austenite matrix and that the alloys have grain size equally within the range of No. 7–No. 9 by A.S.T.M. grain number.

Next, the steel plates 2.5 mm and 10.0 mm thick as prepared above were 20% colled-rolled to form steel strips 2 mm and 10.0 mm thick respectively. From these steel strips, the tensile test specimens in which the gauge portion is 4 mmW×30 mmL and the creep test specimens (6 mmϕ×30 mmL) were sampled.

The Alloys Nos. 1–7 are within the present invention and Alloy Nos. 8–12 are reference.

And Reference Alloys Nos. 1–5 are type 316 stainless steel, modified type 316 stainless steel, Incoloy 800, Inconel 600 and Hastelloy X® respectively.

As will be readily understood by those skilled in the art, the term "balance" as used herein in referring to the iron content of the alloys does not preclude the presence of other elements, e.g. deoxidizing and cleasing elements, and impurities normally associated therewith in small amounts which do not adversely affect the basic characteristics of the alloys.

TENSILE TEST

Tensile test at high temperature was carried out using Instron type tensile strength test machine at 675° C. and at straining rate of 0.7%/min. Tables 2 and 3 illustrate the results of tensile test at 675° C. for annealed specimens and 20% colled-rolled specimens respectively. As is clear from Tables 2 and 3, the yield strength and tensile strength of alloys Nos. 1–7 are higher than those of Reference alloys Nos. 8–11 and come close to the strength property of Reference alloy No. 12 (Hostelloy X®), one of the typical nickel base heat resisting alloys.

CREEP RUPTURE TEST

The creep rupture tests were carried out in air by multi-type testers up to 1,000 hours to evaluate the creep strength of specimens conveniently. Test temperatures were set at 700° and 750° C., i.e. severer than the expected service condition. The values of the 10,000 hour creep rupture strength at 675° C. were obtained by using the Larson-Miller parameters calculated by the equation $$L-M\cdot P=T(17+\log t)\times 10^{-3}$$

where T and t denote the test temperature in °K. and the rupture life in hours respectively.

Tables 4 and 5 illustrate the creep rupture strength at 675° C.×10,000 hr of annealed specimens and 20% colled-rolled creep test specimens respectively. As is clear from Tables 4 and 5, the creep rupture strength of alloys Nos. 1–7 is higher than those of the Reference alloys and come close to the creep rupture strength of Reference alloy No. 12 (Hastelloy X®) one of the typical nickel base heat resisting alloys.

The improvement in the strength of the alloys of the present invention shown in Tables 2–5 is approximately proportional to the increase in nickel, molybdenum and tungsten contents and also to the decrease in chromium content and prove that the mechanism of the solid solution strengthening due to molybdenum and tungsten plays an important role in the improvement of the strength.

VICKER'S HARDNESS TEST

Solid solution treated specimen was 50% cold-worked to prepare a test specimen. The room temperature Vicker's Hardness tests were carried out on the 50% cold worked materials after the subsequent aging for various durations at 850° C. FIG. 1 shows the results obtained. It is proved from the results shown in FIG. 1 that the resistance to softening trends of alloy of the present invention (alloy Nos. 1 and 2–7) is higher than for the Reference alloys Nos. 8, 9 and 10 and comes close to that of Reference alloy No. 12, a "Hastelloy-X" ® one of the typical nickel base heat resisting alloys.

VOID SWELLING TEST

Void swelling test was carried out by irradiating alloy of the present invention (alloy Nos. 1 and 3) and Reference alloy (Reference alloy No. 8) with electron beam in an electron microscope with an accelerating voltage of 1 MV which is one of the convenient test methods of simulating neutron irradiation. The irradiation was carried out at 550° C. at which the swelling of Reference alloy No. 8 becomes largest. The results obtained are shown in Table 6. As shown in Table 6, the void swelling of alloys of the present invention (alloy Nos. 1 and 3) is substantially reduced.

It is noted from these data shown in these tables that the solid solution strengthened iron-base austenitic alloys of the present invention are excellent in tensile and creep-rupture strength and resistance to softening trends at elevated temperatures compared with the conventionally used alloys, and are suitable for heat-resisting materials used at 600° C. and above, and are suitable for core materials of high temperature nuclear reactors.

Although the present invention has been described in conjunction with preferred embodiments, it is to be understood that modifications and variations may be made without departing from the spirit and scope of to be within the purview and scope of the invention and appended claims.

TABLE-1

| Alloy No. | Chemical Composition (Wt. %) | | | | | | | | | |
|---|---|---|---|---|---|---|---|---|---|---|
| | Cr | Ni | Fe | Mo | W | Mn | Si | Ti | C | |
| 1 | 12.9 | 20.0 | bal | 5.46 | 0.01 | 1.73 | 0.33 | 0.24 | 0.07 | |
| 2 | 12.9 | 20.0 | bal | 7.39 | 0.01 | 0.50 | 0.18 | 0.12 | 0.06 | |
| 3 | 12.9 | 20.0 | bal | 4.96 | 4.87 | 0.50 | 0.18 | 0.12 | 0.06 | |
| 4 | 13.1 | 19.9 | bal | 2.54 | 9.67 | 0.52 | 0.16 | 0.14 | 0.06 | present |
| 5 | 13.1 | 22.2 | bal | 0.25 | 14.30 | 0.50 | 0.15 | 0.11 | 0.08 | invention |
| 6 | 13.1 | 22.2 | bal | 7.84 | 7.09 | 0.49 | 0.16 | 0.11 | 0.07 | |
| 7 | 13.0 | 22.9 | bal | 8.32 | 7.76 | 0.49 | 0.16 | 0.13 | 0.08 | |
| 8 (type 316) | 16.6 | 13.1 | bal | 2.24 | 0.01 | 1.63 | 0.56 | 0.01 | 0.06 | |
| 9 (modified type 316) | 16.0 | 13.9 | bal | 2.52 | 0.01 | 1.73 | 0.89 | 0.11 | 0.07 | |
| 10 (Incoloy 800) | 20.0 | 32.2 | bal | 0.01 | 0.01 | 1.30 | 0.52 | 0.01 | 0.033 | Reference |
| 11 (Inconel 600) | 15.4 | bal | 7.0 | 0.01 | 0.01 | 0.50 | 0.41 | 0.01 | 0.022 | |
| 12 (Hastelloy X) | 21.5 | bal | 18.0 | 9.11 | 0.65 | 0.60 | 0.18 | 0.01 | 0.07 | |

TABLE-2

| Alloy No. | $\sigma_{0.2}$ (kg/mm$^2$) | $\sigma_B$ (kg/mm$^2$) | $\epsilon$(%) |
|---|---|---|---|
| 1 | 19.6 | 38.4 | 29.7 |
| 2 | 20.1 | 39.0 | 28.1 |
| 3 | 23.2 | 42.3 | 33.1 |
| 4 | 23.1 | 42.6 | 31.7 |
| 5 | 23.6 | 44.0 | 29.5 |
| 6 | 24.0 | 45.4 | 32.4 |
| 7 | 24.3 | 46.7 | 31.9 |
| 8 (type 316) | 11.2 | 29.9 | 37.0 |
| 9 (modified type 316) | 11.9 | 30.1 | 38.5 |
| 10 (Incoloy 800) | 12.0 | 28.5 | 45.0 |
| 11 (Inconel 600) | 13.6 | 36.0 | 23.0 |
| 12 (Hastelloy X) | 26.3 | 53.0 | 41.0 |

TABLE-3

| Alloy No. | $\sigma_{0.2}$ (kg/mm$^2$) | $\sigma_B$ (kg/mm$^2$) | $\epsilon$ (%) |
|---|---|---|---|
| 1 | 45.4 | 49.4 | 12.5 |
| 2 | 46.5 | 50.7 | 10.4 |
| 3 | 50.2 | 54.1 | 15.3 |
| 4 | 52.1 | 55.9 | 14.7 |

TABLE-3-continued

| Alloy No. | $\sigma_{0.2}$ (kg/mm$^2$) | $\sigma_B$ (kg/mm$^2$) | $\epsilon$ (%) |
|---|---|---|---|
| 5 | 54.0 | 57.8 | 11.2 |
| 6 | 55.8 | 59.7 | 14.8 |
| 7 | 57.5 | 61.5 | 14.1 |
| 8 (type 316) | 40.1 | 42.0 | 14.8 |
| 9 (modified type 316) | 40.8 | 42.2 | 17.7 |

TABLE-4

| Alloy No. | Kg/mm$^2$ |
|---|---|
| 1 | 11.4 |
| 2 | 11.9 |
| 3 | 12.3 |
| 4 | 12.9 |
| 5 | 13.6 |
| 6 | 14.1 |
| 7 | 14.7 |
| 8 (type 316) | 8.6 |
| 9 (modified type 316) | 10.0 |
| 10 (Incoloy 800) | 8.7 |
| 11 (Inconel 600) | 7.3 |
| 12 (Hastelloy X) | 15.1 |

TABLE-5

| Alloy No. | Kg/mm$^2$ |
|---|---|
| 1 | 14.7 |
| 2 | 15.3 |
| 3 | 15.9 |
| 4 | 16.6 |
| 5 | 17.5 |
| 6 | 18.1 |
| 7 | 18.9 |
| 8 (type 316) | 12.0 |
| 9 (modified type 316) | 12.9 |

TABLE-6

| Alloy No. | Heat-treatment(1) | dpa(2) | Δv/v, % |
|---|---|---|---|
| 1 | ST | 17.6 | <<0.05 |
| | AG | 17.5 | <<0.05 |
| 3 | ST | 18.2 | 0 |
| | AG | 23.3 | 0 |
| 8 | ST | 17.5 | 1.5 |
| | | 18.2 | 1.5 |
| | | 23.3 | 2.3 |

(1)ST: 1100° C. × 30 min. W.Q.
AG: 650° C. × 3000 hr.
(2)Value for SUS type 316 stainless steel.

What is claimed is:

1. A solid solution strengthened iron-base austenitic alloy having remarkably improved strength and resistance to softening trends at elevated temperatures consisting essentially of 8–13.1% by weight of Cr, 14–30% by weight of Ni, 5–15% by weight of Mo plus 0.522 W, up to 1.0% by weight of Ti, up to 2% by weight of Mn, up to 1% by weight of Si, up to 0.1% by weight of C and the balance iron and unavoidable impurities.

2. An alloy according to claim 1, wherein the maximum quantity of Ni is 22.9% by weight.

3. A solid solution strengthened iron-base austenitic alloy having remarkably improved strength and resistance to softening trends at elevated temperatures, consisting essentially of 8–16.0% by weight Cr (exclusive of 16.0%), 14 to 35% by weight of Ni, 5–15% by weight of Mo plus 0.522 W, 0.11–1.0% by weight of Ti, up to 2% by weight of Mn, up to 1% by weight of Si, up to 0.1% by weight of C and the balance iron and unavoidable impurities.

4. A core element of an LMFBR formed of a solid solution strengthened iron-base austenitic alloy having remarkably improved strength and resistance to softening trends at elevated temperatures consisting essentially of 8–16% by weight of Cr, 14–35% by weight of Ni, 5–15% by weight of Mo plus 0.522 W, a quantity of Ti of up to 1.0% by weight, a quantity of Mn of up to 2% by weight, a quantity of Si of up to 1% by weight, a quantity of C of up to 0.1% by weight and the balance iron and unavoidable impurities.

5. A process comprising the new use, as a core element of an LMFBR, of a solid solution strengthened iron-base austenitic alloy having remarkably improved strength and resistance to softening trends at elevated temperatures consisting essentially of 8–16.0% by weight of Cr, 14–35% by weight of Ni, 5–15% by weight of Mo plus 0.522 W, a quantity of Ti of up to 1.0% by weight, a quantity of Mn of up to 2% by weight, a quantity of Si of up to 1% by weight, a quantity of C of up to 0.1% by weight and the balance iron and unavoidable impurities.

* * * * *